United States Patent [19]

Lindstadt et al.

[11] Patent Number: 4,776,272

[45] Date of Patent: Oct. 11, 1988

[54] PROJECTILE-FORMING CHARGE

[75] Inventors: Klaus Lindstadt, Schwaig; Karl Rudolf, Schrobenhausen, both of Fed. Rep. of Germany

[73] Assignee: Diehl GmbH & Co., Nuremberg, Fed. Rep. of Germany

[21] Appl. No.: 69,294

[22] Filed: Jul. 2, 1987

[30] Foreign Application Priority Data

Jul. 31, 1986 [DE] Fed. Rep. of Germany ..... 3625966

[51] Int. Cl.[4] ..... F42B 1/02

[52] U.S. Cl. ..... 102/307; 102/309; 102/476

[58] Field of Search ..... 102/306–310, 102/476, 493, 495

[56] References Cited

U.S. PATENT DOCUMENTS

| | | | |
|---|---|---|---|
| 4,300,453 | 11/1981 | Bigler | 102/309 X |
| 4,305,333 | 12/1981 | Altenau et al. | 102/306 |
| 4,312,274 | 1/1982 | Zernow | 102/493 |

*Primary Examiner*—Peter A. Nelson

*Attorney, Agent, or Firm*—Scully, Scott, Murphy & Presser

[57] ABSTRACT

An armor-rupturing projectile-forming charge wherein the charge is adapted to selectively produce either single compact projectile, or through suitable measures to be able to concurrently produce a plurality of projectiles, so as to attack hard or heavily-armored targets, such as tank, as well as or lightly-armored, or even unarmored targets through a projectile which is correlated with the target.

7 Claims, 5 Drawing Sheets

PROJECTILE-FORMING CHARGE

BACKGROUND OF THE INVENTION

1. Field of the Invention

The present invention relates to a projectile-forming charge including a housing, an explosive charge, a detonator device, and an insert.

2. Discussion of the Prior Art

From the disclosure of U.S. Pat. No. 4,590,861, commonly assigned to the assignee of this application, there has become known a projectile-forming insert. This insert is deformed through the energy of an explosive into a compact and inherently stable airborne projectile. For the utilization of projectile-forming charges against battle tanks, the components of the charge are so optimized with regard to each other, that a highly-effective projeciile is produced from the insert almost without any loss in material or matter. The effect in the battle tank, in this instance, to a considerable extent results from the formation of a large number of generated secondary splinters or fragments, which are struck out of the relatively thick armoring of the target. However, with respect to their deployment against lightly-armored vehicles, these projectiles are over-dimensioned.

The foregoing is essentially due to the projectile being fired so as to pass through the vehicle without any substantial formation of secondary splinters or fragments.

SUMMARY OF THE INVENTION

Accordingly, it is an object of the present invention to construct an armor-rupturing projectile-forming charge in such a manner, that the charge is adapted to selectively produce either a single compact projectile, or through suitable measures, to be able to concurrently produce a plurality of projectiles, so as to be able to attack hard or heavily-armored targets, such as a battle tank, as well as lightly-armored, or even unarmored targets through a projectile which is correlated with the target.

The foregoing object is achieved through the intermediary of a projectile-forming charge as described herein in which in either the casing of the charge, or within the particle stream or jet-forming region, are there provided sector-like and removable disruptive or interference media.

Essential to the invention is the basic assumption of providing a projectile-forming charge for the formation of an armor-rupturing projectile, as well as for the formation of individual projectiles which are effective against lightly-armored or unarmored vehicles. The selective employment for the charge is facilitated through simple additional constructive measures. These measures are predicated on the basic concept, that for the generation of a plurality of projectiles, the projectile-forming insert is converted on the basis of a number of detonation wave zones into correspondingly numerous projectiles.

The effect of the armor-rupturing projectile charge against the lightly-armored vehicles is then increased, when due to measures provided on the charge, there is distorted the detonation front which uniformly propagates from the axial detonation point, or when the damming through the casing along the periphery of the charge or in the region of the covering is variable, and as a result, there are formed a plurality of projectiles.

BRIEF DESCRIPTION OF THE DRAWINGS

The advantageously employable measures may now be readily ascertained by reference to the following detailed description of exemplary embodiments of the invention, taken in conjunction with the accompanying generally diagrammatic drawings representative of arrangements of projectile-forming charges; in which.

DETAILED DESCRIPTION

Figure 1:
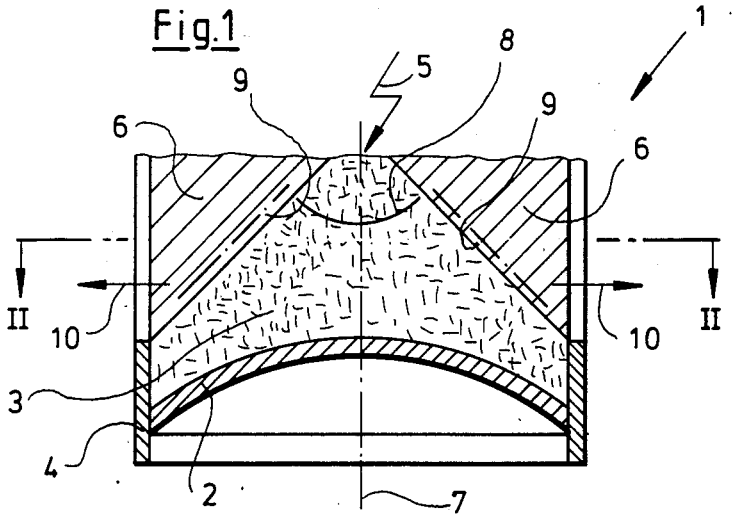
FIGS. 1 and 2, respectively illustrate a longitudinal and transverse sectional view through a charge with damming components arranged about the circumference.
Figure 2:
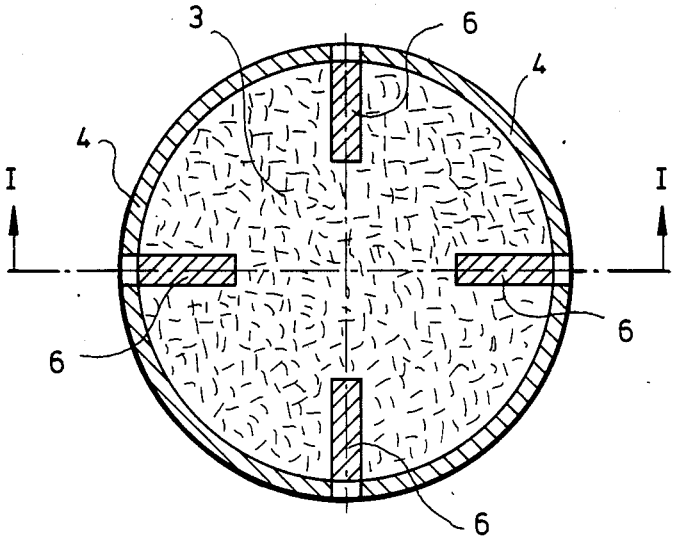

In accordance with FIGS. 1 and 2 of the drawings, a charge 1 possessing an insert 2, an explosive charge 3, a casing 4, a central detonator device 5, has four damming parts 6 provided therein, which are radially displaceable in the direction of arrows 10. The mechanism for the sliding is implemented through a known cam guidance control. The propagated detonation wave 8 is non-uniformly reflected with the displaced damming parts 6 due to the symmetrically present gap 9 of approximately 2 mm at a caliber of 150 mm. This leads to the formation of four projectile flying off in parallel with the primary or main axis 7. At contacting damming parts 6, in effect, in which there is no presence of any gap 9, only a single projectile is formed, which is not illustrated herein.

Figure 3:
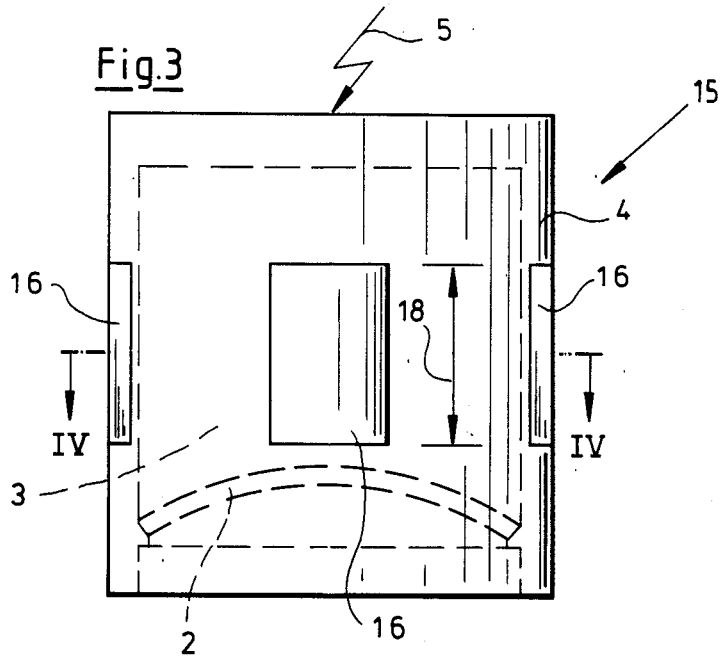
FIGS. 3 and 4 illustrate, respectively, views similar to FIGS. 1 and 2 of a charge with a casing which includes two segments which can be ejected or cast off.
Figure 4:
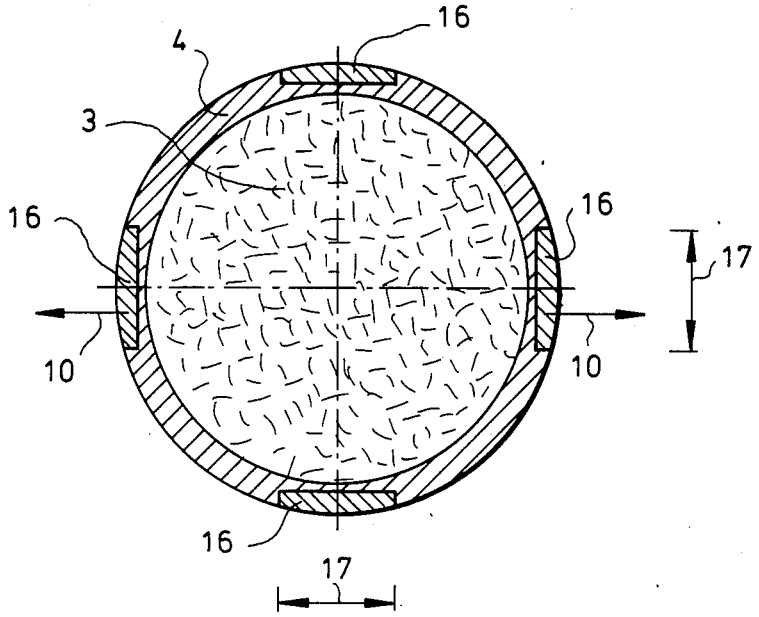

Pursuant to the embodiment of FIGS. 3 and 4, in the casing 4 of a charge 15 there are provided four ejectable sections 16 which can be cast off or ejected through a gas pressure, and which each possess the width 17 and the height 18. At cast off sections 16, the detonation wave is reflected substantially in the regions of the sections 16, such that there are produced four projectiles instead of a single projectile.

Figure 5:
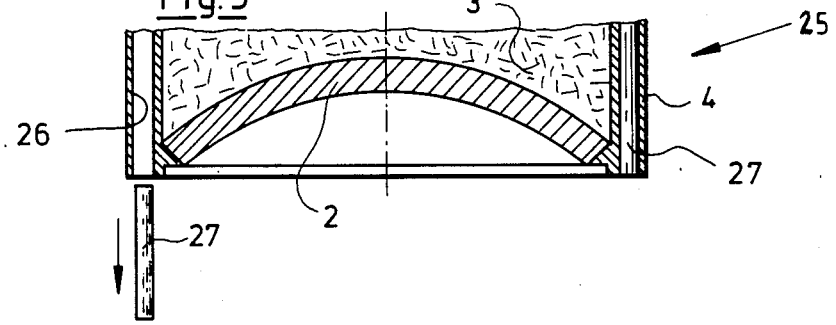
FIG. 5 illustrates a charge with a casing and pins which are outwardly ejectable therefrom.

As shown in the embodiment of FIG. 5, a charge 25 is provided with bores 26 in the casing 4 in conformance with the width 17 of the sections 16 as shown in FIGS. 3 and 4, through which there are ejectable applicable pins 27 through the action of a gas pressure.

The manner of functioning of the charges 15 and 25 corresponds to that of the charge 1. At removed sections 16 or, respectively, at a corresponding ejection of the pins 27, upon the detonation of the hollow charge 15 or 25, instead of one projectile, there are produced four projectiles, or in essence, heavy splinters or fragments.

Figure 6:
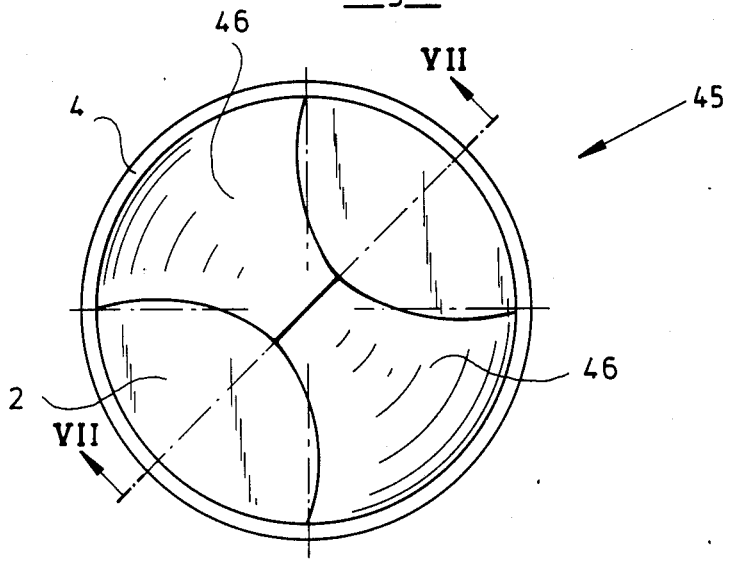
FIGS. 6 and 7, respectively, illustrate a charge which has the side of the insert facing towards the target covered with segments.
Figure 7:
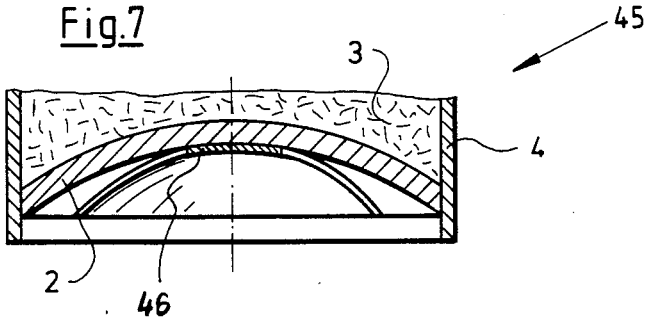

In accordance with FIGS. 6 and 7, the insert 2 of a charge 45 is covered by two spherical segments 46 which are constituted of steel sheeting. In the attacking of a heavily-armored vehicle, such as a battle tank, these segments 46 are previously expelled. For the attacking of lightly-armored vehicles, the segments 46 remain in front of the insert 2. These segments 46, upon the detonation of the hollow charge lead to the formation of four projectiles or, respectively, four heavy splinters or fragments.

Figure 8:
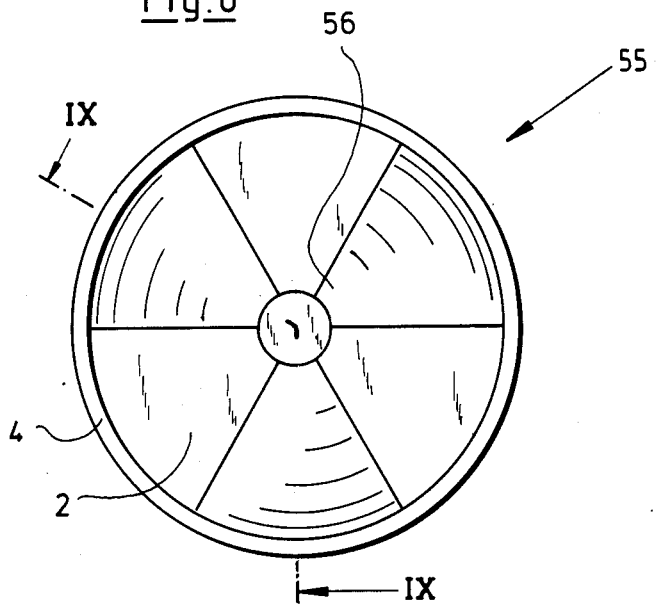
FIGS. 8 through 11, respectively, illustrate charges with segments in the region of the projectile formation.
Figure 9:
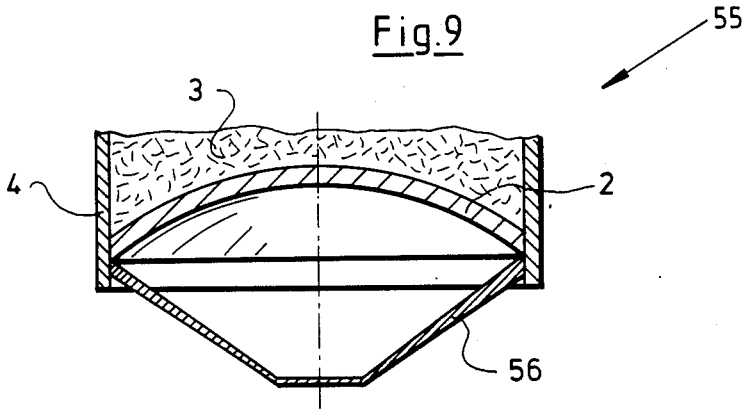
Figure 10:
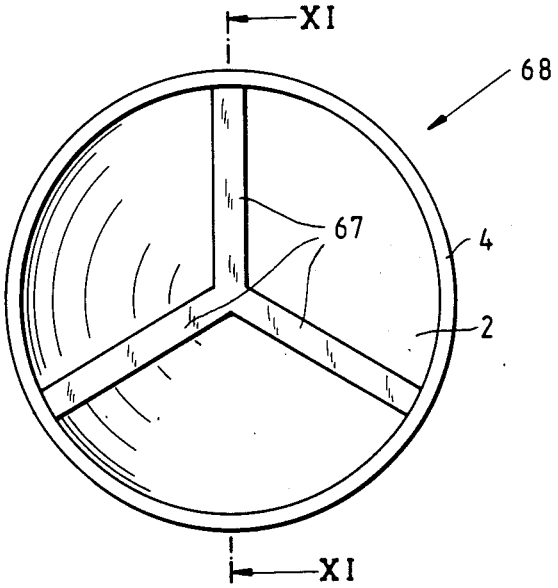
Figure 11:
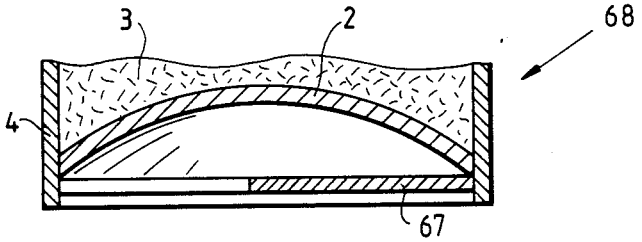

Pursuant to the embodiment of FIG. 8, a charge 55 is provided with a forwardly-located, ejectable fan-shaped or sectored disc 56, referring also to the above-mentioned segments 46 pursuant to FIGS. 7 and 8 or the rod-like arm 67 of the charge 68 constituted of glass fiber-reinforced plastic material in accordance with FIGS. 10 and 11. For the formation of a plurality of projectiles, the segments 56 or respectively arms 67 remain in the illustrated positions. The streams of solid particles which are produced during the conversion of the insert by the explosive are initially guided, in effect, in the decisive stadium, through the segments 56, or through the arms 67, so that instead of a single projectile there are formed a plurality of projectiles. The relatively short period of effectiveness for the segments 46 (FIG. 6), of the segments 56 (FIG. 8), and of the arms 67 (FIG. 10) is completely adequate for this purpose.

What is claimed is:

1. In a projectile-forming charge for selectively producing a single compact projectile or a plurality of projectiles, including a casing housing said charge, an explosive charge, detonator means and an insert, the improvement comprising in that sector-like and detachable disruptive means are provided on either the casing of the charge or within a particle jet-forming zone for the selective production of said single compact projectile or said plurality of projectiles in correlation with the type of a target object which is to be attacked.

2. A charge as claimed in claim 1, wherein at least two sectorially-shaped damming components are arranged on said casing displaceable in a radial direction at the circumference of the explosive charge for the formation of air gaps.

3. A charge as claimed in claim 1, wherein the casing of the charge is constituted of a plurality of ejectable sections which weaken the wall strength of the casing.

4. A charge as claimed in claim 1, wherein the casing of the charge has the end surface and sections thereof provided with bores; and including ejectable pins arranged in said bores.

5. A charge as claimed in claim 1, wherein said charge has the insert provided with ejectable, sector-shaped sheet metal segments.

6. A charge as claimed in claim 1, wherein in front of the insert there are positioned segments or arms which are ejectable and which restrict the stream of the explosive-accelerated material particles of the insert.

7. A charged as claimed in claim 6, wherein the arms are constituted of glass fiber-reinforced plastic material.

* * * * *